US007755451B2

(12) United States Patent
Krausse et al.

(10) Patent No.: US 7,755,451 B2
(45) Date of Patent: Jul. 13, 2010

(54) DIRECTIONAL COUPLER

(75) Inventors: Daniel Krausse, Freiburg (DE); Christoph Gerhardt, Freiburg (DE); Peter Riessle, St. Märgen (DE); Thomas Kirchmeier, Teningen (DE); Erich Pivit, Allmersbach im Tal (DE)

(73) Assignee: HUETTINGER Elektronik GmbH + Co. KG, Freiburg (DE)

( * ) Notice: Subject to any disclaimer, the term of this patent is extended or adjusted under 35 U.S.C. 154(b) by 284 days.

(21) Appl. No.: 11/689,043

(22) Filed: Mar. 21, 2007

(65) Prior Publication Data

US 2008/0036554 A1 Feb. 14, 2008

Related U.S. Application Data

(60) Provisional application No. 60/745,791, filed on Apr. 27, 2006.

(30) Foreign Application Priority Data

Mar. 25, 2006 (EP) ..... 06006202

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 116, 238
See application file for complete search history.

(56) References Cited

U.S. PATENT DOCUMENTS

| | | | | |
|---|---|---|---|---|
| 3,601,716 A | | 8/1971 | Bolt et al. | 333/116 |
| 4,809,356 A | * | 2/1989 | Peckham et al. | 455/86 |
| 5,006,821 A | * | 4/1991 | Tam | 333/116 |
| 5,424,694 A | | 6/1995 | Maloratsky et al. | 333/112 |
| 5,625,328 A | | 4/1997 | Coleman, Jr. | 333/116 |
| 5,767,753 A | | 6/1998 | Ruelke | 333/116 |
| 6,756,859 B2 | * | 6/2004 | Kodim | 333/101 |
| 2002/0050486 A1 | | 5/2002 | Ishii et al. | 219/121.43 |
| 2002/0113667 A1 | | 8/2002 | Tahara et al. | |

(Continued)

FOREIGN PATENT DOCUMENTS

DE 10 2004 021 535 7/2005

(Continued)

OTHER PUBLICATIONS

Search Report for corresponding application serial No. EP 06006202.3, mailed Sep. 4, 2006.

*Primary Examiner*—Dean O Takaoka
(74) *Attorney, Agent, or Firm*—Fish & Richardson P.C.

(57) ABSTRACT

An HF plasma process excitation configuration includes an HF generator that is connected to a plasma load through a directional coupler. The directional coupler includes a transmission line, a first coupling line for detecting reflected power from the plasma load, and a second coupling line for detecting forward power from the HF generator, is the first coupling line is spaced apart from the transmission line and is terminated at least at one end with a termination resistance. The second coupling line is spaced apart from the transmission line and is terminated at least at one end with a termination resistance. Each coupling line has a predetermined and adjusted characteristic impedance, and the termination resistances each have a resistance value that corresponds within a tolerance to the characteristic impedance of the associated coupling line with a tolerance.

23 Claims, 3 Drawing Sheets

U.S. PATENT DOCUMENTS

2005/0212617 A1 9/2005 Chen ..... 333/116

FOREIGN PATENT DOCUMENTS

| | | |
|---|---|---|
| EP | 1014472 | 6/2000 |
| JP | 05014019 | 1/1993 |
| JP | 07153599 | 6/1995 |
| JP | 08203692 | 8/1996 |
| WO | WO2006105847 | 10/2006 |

* cited by examiner

DIRECTIONAL COUPLER

CROSS REFERENCE TO RELATED APPLICATION

This application claims priority under 35 U.S.C. §119(a) to European Application No. 06 006 202.3, filed on Mar. 25, 2006, and under 35 U.S.C. §119(e) from U.S. Provisional Application No. 60/745,791, filed Apr. 27, 2006. Both of these priority applications are hereby incorporated by reference in their entirety.

TECHNICAL FIELD

The invention relates to a directional coupler for a high frequency plasma process excitation configuration.

BACKGROUND

High frequency (HF) plasma process excitation configurations include an HF generator that supplies HF power to a plasma process (which is the plasma load). The HF power is normally supplied to the plasma process in a narrow frequency band, for example, between about 10-30 MHz, or at about industrial frequencies of 13.56 MHz or 27.12 MHz. A measuring device can be provided for measuring the power supplied to the plasma process. The supplied power is detected with the use of the measuring device in order to enable accurate closed-loop and/or open-loop control of the power.

There are different methods to measure or determine the power supplied to the plasma load of an HF plasma process excitation system. For example, the measuring device can be a directional coupler. A directional coupler can determine the forward power $P_i$ (that is, the power supplied to the plasma load) and the reflected power $P_r$ (that is, the power reflected from the plasma load). Directional couplers decouple part of the power that is guided through a transmission line (that is, a conductor that transmits electrical power of the HF generator to the plasma load) of the directional coupler.

If the transmission line is a strip line, then a directional coupler can be used to measure or determine the power. In this case, the directional coupler can have a length of one quarter of a wavelength $\lambda$ that is inversely related to the frequency of the HF signal from the HF generator. Such lengths would be large for a system that is operated in a range of between 10 and 30 MHz.

The directional couplers disclosed in prior art, e.g., in DE 10 2004 021 535 A1 and in U.S. Publication No. 2005/0212617 A1 are designed for frequencies of, for example, 1 GHz and more, in which case strip line theory plays a substantial role.

In conventional directional, couplers, one coupling line extends parallel to the transmission line. A small part of the power is decoupled from the transmission line, which supplies the power of the generator to the load, to the coupling line through electrical and magnetic coupling. A power that is proportional to the reflected power can be tapped at one end of the coupling line, and a power that is proportional to the forward power can be tapped at the other end.

SUMMARY

In one general aspect, an HF plasma process excitation configuration includes a directional coupler. The directional coupler includes a transmission line, a first coupling line for detecting reflected power by electrical coupling with the transmission line, and a second coupling line for detecting forward power by electrical coupling with the transmission line. The first coupling line is spaced apart from the transmission line and is terminated at least at one end with a termination resistance. The second coupling line is spaced apart from the transmission line and is terminated at least at one end with a termination resistance. Each coupling line has a predetermined and adjusted characteristic impedance, and the termination resistance of each of the coupling lines has a resistance value that corresponds to the characteristic impedance of the associated coupling line.

Implementations can include one or more of the following features. For example, the resistance values of the termination resistances can correspond within a tolerance of less than ±10% to the characteristic impedance. The resistance values of the termination resistances can correspond within a tolerance of less than ±5% to the characteristic impedance. The resistance values of the termination resistances can correspond within a tolerance of less than ±1% to the characteristic impedance.

The directional coupler can include a first ground reference potential, and the first and second coupling lines can be disposed at a predetermined separation from the first ground reference potential. The directional coupler can include two ground reference potentials, the coupling lines can be disposed between the ground reference potentials, and the separation of the coupling lines from at least one ground reference potentials can be predeterminable.

The directional coupler can include two ground reference potentials, the coupling lines can be disposed between the ground reference potentials, and the separation of the coupling lines from both ground potentials can be predeterminable.

The directional coupler can include two ground reference potentials defined by two ground surfaces, and the coupling lines can be disposed between the two ground surfaces. The directional coupler can include a ground reference potential defined by a ground surface, and the transmission line can be disposed in the same plane as and be electrically insulated from the ground surface.

The directional coupler can be designed such that no coupling line is between the transmission line and a ground potential.

Each of the coupling lines can have exclusively a termination resistance at one end.

Parallel sections of the coupling lines and the transmission line can have a length of less than about $\lambda/4$, where $\lambda$ is the wavelength of the power signal from an HF generator to a plasma load through the transmission line.

The forward power and the reflected power, or quantities describing the forward power and the reflected power, can be decoupled from the transmission line with different coupling factors.

The first and the second coupling lines can be disposed at different separations from the transmission line. The transmission line, the first coupling line, and the second coupling line can be disposed in different planes. The coupling lines can be offset from each other. The first coupling line, the second coupling line, and the transmission line can be separated from each other by an electrically insulating material. The electrically insulating material can include a printed circuit board material.

The directional coupler can be designed for operation at frequencies of less than about 200 MHz. The directional coupler can be designed for operation at frequencies of less than about 40 MHz.

The transmission line can include an input terminal and an output terminal. The transmission line can receive at its input terminal forward power from an HF generator and can deliver at its output terminal the forward power to a plasma load.

In another general aspect, a high frequency (HF) plasma process excitation configuration includes a directional coupler. The directional coupler includes a transmission line including an input terminal and an output terminal a first coupling line for detecting reflected power by electrical coupling with the transmission line, and a second coupling line for detecting forward power by electrical coupling with the transmission line. The first coupling line is spaced apart from the transmission line and is terminated at least at one end with a termination resistance. The second coupling line is spaced apart from the transmission line and is terminated at least at one end with a termination resistance. Each coupling line has a predetermined and adjusted characteristic impedance, and the termination resistances of the coupling lines each have a resistance value that corresponds to the characteristic impedance of the associated coupling line.

Implementations can include one or more of the following features. For example, most of the return current can flow from a plasma load to an HF generator through a ground surface of the directional coupler. More than about 90% of the return current can flow from the plasma load to the HF generator through the ground surface of the directional coupler.

The HF resistance for the return current between an output terminal of the HF plasma excitation configuration and a ground potential of the directional coupler can be smaller than the HF resistance of a housing between the output terminal and the ground potential of the housing.

In another general aspect, power supplied to a plasma load of an HF plasma excitation configuration is measured using a method. The method includes transferring a forward power from an HF generator to the plasma load through a transmission line, electrically decoupling reflected power from the plasma load at a first coupling line that is spaced apart from the transmission line and is terminated at least at one end with a termination resistance, electrically decoupling the forward power from the HF generator at a second coupling line that is spaced apart from the transmission line and is terminated at least at one end with a termination resistance, predetermining and adjusting a characteristic impedance of each coupling line, and corresponding the termination resistances of the coupling lines to the characteristic impedance of the associated coupling line.

In the directional coupler of the above-mentioned type, each coupling line has a predetermined and adjusted characteristic impedance, and the termination resistances have a resistance value that corresponds to the characteristic impedance of the associated coupling line with a tolerance $<\pm 10\%$, in particular $<\pm 5\%$, preferentially $<\pm 1\%$. Reflections due to mismatch can be prevented at this point through adjustment of the termination resistances to the characteristic impedances. In this fashion, the power can be measured much more precisely. The use of two coupling lines is advantageous in that the forward power and the reflected power can be measured decoupled from one another. The power or a value describing this power can be tapped at the coupling lines. When reflections are generated by circuits, e.g., by filtering of the tapped power, these reflections are absorbed in the termination resistance of the respective coupling line and do not contribute to measuring errors on the other coupling line. The coupling lines preferably extend, at least in sections, parallel to the transmission line.

In some implementations, a first ground reference potential, for example, a first ground surface, can be provided, and the first and second coupling lines are disposed at a predetermined separation from the ground potential. The characteristic impedances of the coupling lines can be adjusted with high precision by selecting or predetermining the separations. Due to the fixed reference potential, a fixed characteristic impedance can be predetermined with high precision, reliability, and high repetition accuracy. A characteristic impedance that is commonly used in industry can be set. A characteristic impedance of, e.g., 50 ohms or 75 ohms can be used. Additionally, the length and/or width of the coupling lines can be suitably predetermined to realize the characteristic impedance.

In some implementations, two ground reference potentials can be provided, the coupling lines can be disposed between the ground reference potentials, and the separation from at least one, preferably both, ground reference potentials is or can be predetermined. The predetermined characteristic impedance can be precisely adjusted with one ground reference potential, and the electric coupling between the transmission line and the coupling lines can be adjusted with the second ground reference potential.

In other implementations, the coupling lines can be disposed between two ground surfaces. The coupling lines can be embedded between insulating materials, e.g., printed circuit boards, which support the ground surfaces. In this fashion, the directional coupler can be manufactured in a particularly simple, inexpensive, and highly precise fashion.

Further advantages can be achieved by disposing the transmission line in the same plane as a ground surface, but being insulated therefrom. When the lines are relatively short, for example, shorter than about $\lambda/4$, then coupling in accordance with line theory can be neglected. Coupling is rather effected through electrical and magnetic fields. The electric and magnetic couplings should be balanced. Magnetic coupling is obtained through the progression of the lines of magnetic flux in the area of the section where the coupling lines are guided in the direct vicinity of the transmission line. Short lines imply little magnetic coupling. Little electric coupling is also required for the balance. The electric coupling is produced through the progression of the lines of electric flux between the transmission line and the respective coupling line, and the area of the respective coupling line. The progression of the lines of flux can be deflected by a ground surface on the same plane as the transmission line and be directed away from the coupling lines. This reduces the electric coupling between the transmission line and the coupling lines.

The lines of flux of the electric field can be diverted even when there is no coupling line between the transmission line and a ground potential, in particular, a ground surface, in order to reduce the electric coupling between the transmission line and the coupling lines.

When the coupling lines have only a termination resistance at one end, which is preferably matched, the power at the respective other end can be decoupled. "Matched termination resistance" means that the termination resistance is equal to the characteristic impedance of the directional coupler. Reflections produced by the measurement thereby end up in the termination resistance at the other end of the coupling line, produce no new reflections, and do not contribute to measurement errors on the respective other coupling line. The termination resistance can be adjustable. In this case, tolerances in the directional coupler can be compensated for.

The parallel sections of the lines can have a length less than about $\lambda/4$, in particular less than about $\lambda/8$, preferentially less than about $\lambda/10$. In this fashion, the dimensions of the directional coupler can be kept small.

The forward power and the reflected power or values describing them can be decoupled with different coupling factors. The reflected power is usually smaller than the forward power. When it can be decoupled with a larger coupling factor, the signal-to-noise ratio at the input of the evaluation device that detects the power increases, since the dynamic of the evaluation device that detects the power is advantageously utilized. The reflected power can thereby be measured more precisely.

Different coupling factors can be realized in a particularly simple fashion when the first and the second coupling line are disposed at different separations from the transmission line.

Different coupling factors can be realized with a simple, precise, and inexpensive production method of the directional coupler by disposing the transmission line, the first coupling line, and the second coupling line in different planes.

The coupling lines can be offset from each other to prevent coupling between the coupling lines and thereby reduce impairment of the measuring results.

The separation between the lines can be adjusted in a precise and reproducible fashion when the lines are spaced apart by an electrically insulating material, for example, a printed hoard material.

When the directional coupler is designed for operation at frequencies <200 MHz, in particular <40 MHz, it is particularly suited for operation in HF plasma process excitation configurations.

A significant part of the return current, for example, more than 90% of the return current, flows from a plasma load to an HF generator through a ground surface of the directional coupler. The significant part of the return current, and, if possible the entire return current, should flow on the ground surface. This ensures build-up of the electric field that is required for the electric coupling between the transmission line and the coupling lines.

The HF resistance for the return current between the output terminal of the HF plasma process excitation configuration and a ground potential of the directional coupler can be smaller than the HF resistance of a housing between the output terminal and the ground potential of the housing. The output can be formed as a coaxial connector, on the outer conductor of which the return current flows. The entire or most of the current flows through the ground reference surface of the directional coupler. The very small DC resistance, which each conventional housing represents, can, e.g., be increased by introducing inductances into the current path. Alternatively or additionally, the current path can be built up with particularly little inductance by way of the ground reference potential of the directional coupler to the ground of the HF generator. Towards this end, the mounting screws of the output terminal can have a direct, short, and large-surface connection to the ground surface of the directional coupler. The connection between the ground reference surface of the directional coupler and the ground of the generator can additionally or alternatively also be short and of low inductance.

In the direction coupler, measured values of the forward power and of the reflected power are not impacted or altered by each disturbance returning from the circuit to the coupling line, either due to mismatch of the circuit to the directional coupler, or filtering. The directional coupler provides a more precise measurement of the power supplied to the plasma load. In particular, reflections (such disturbances) are reduced or prevented by adjustment of the termination resistances at the coupling lines in the directional coupler such that the termination resistances absorb such reflections. In this way, the directional coupler can measure power more precisely because the impact of these reflections on measurements is reduced or eliminated.

Further features and advantages of the invention can be extracted from the following description of embodiments of the invention, the figures of the drawing that show details of the invention, and the claims. The individual features may be realized individually or collectively in arbitrary combination in a variant of the invention. The embodiments that are shown and described are not to be understood as a definitive list, being rather of an exemplary nature for describing the invention.

DETAILED DESCRIPTION

Figure 1:
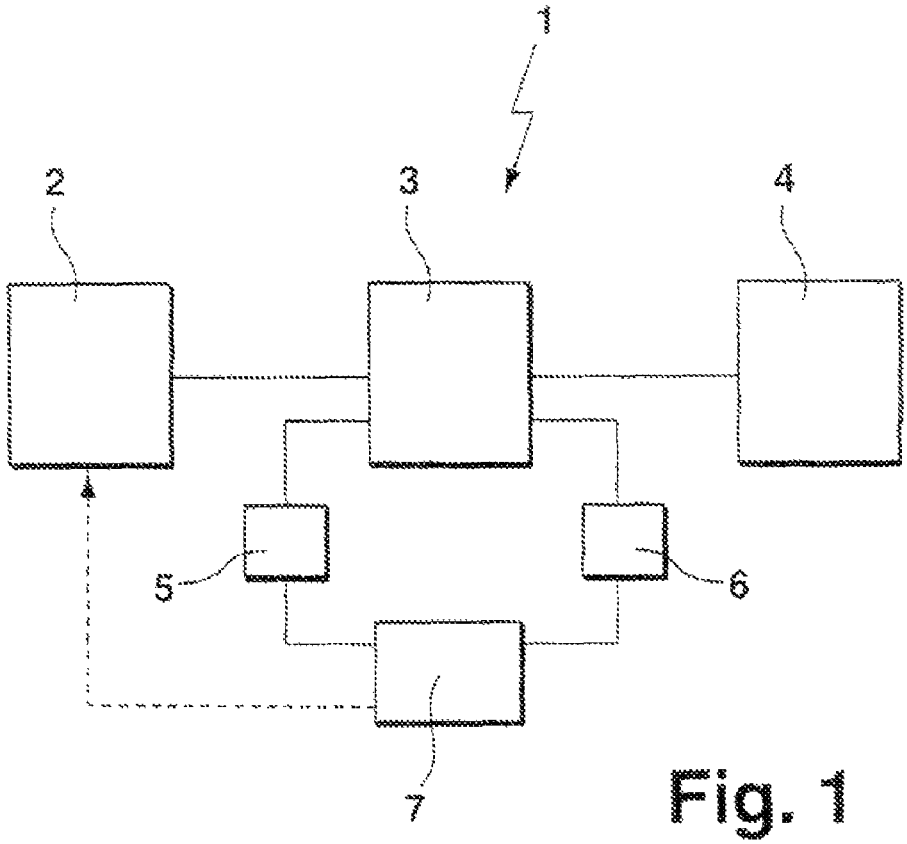
FIG. 1 shows a schematic view of an HF plasma process excitation configuration.

FIG. 1 schematically shows an HF plasma process excitation configuration 1. The HF plasma process excitation configuration 1 includes an HF generator 2 that is connected to a plasma load 4 through a directional coupler 3. The directional coupler 3 decouples signals or quantities related to the forward power (Pi), which is the power provided by the HF generator 2, and the reflected power (Pr), which is the power reflected by the plasma load 4. Towards this end, the configuration includes a first measuring device 5 (in the form of an electrical circuit) to measure the forward power, and a second measuring device 6 (in the form of an electrical circuit) to measure the reflected power. The measuring devices 5, 6 are, in turn, connected to an evaluation device 7 that detects the power and can control the HF generator 2 and thus can control the forward power provided by the HF generator 2 based on the measured powers from the measuring devices 5, 6.

Figure 2:
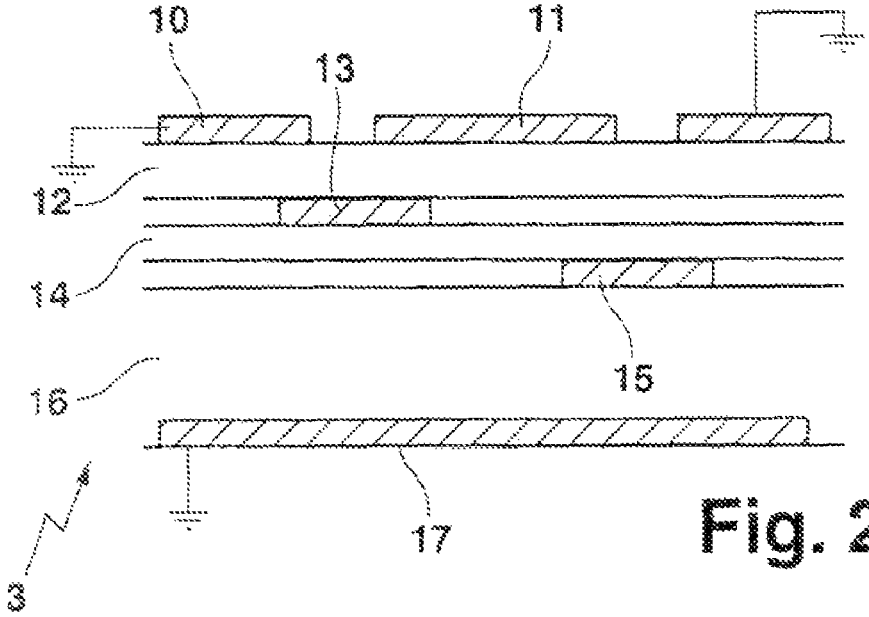
FIG. 2 shows a sectional view through a directional coupler of the configuration of FIG. 1.

FIG. 2 shows a cross-section through the directional coupler 3. The directional coupler 3 includes a first coupling line 13 and a second coupling line 15 that are positioned relative to a transmission line 11 to decouple electrical power (forward power and reflected power, respectively) from the transmission line 11. The transmission line 11, which is electrically insulated, is disposed in the same plane as a ground reference member that is at ground potential (in this implementation, the ground reference member is a first ground surface 10). The forward power is transferred from the HF generator 2 to the plasma load 4 through the transmission line 11. In this implementation, the ground surface 10 and the transmission line 11 are in the same plane and are disposed on an electrical insulator 12 that is designed as a printed circuit board. A first coupling line 13 is disposed in the plane below the electrical insulator 12 for decoupling the reflected power from the plasma load 4. The first coupling line 13 is also disposed on an electrical insulator 14 that is designed as a printed circuit board. The first coupling line 13 is disposed at a predetermined vertical separation and is slightly offset from the transmission line 11. Vertical separation is measured in a direction perpendicular to the plane (and is parallel to the normal of the plane) in which the transmission line 11 is disposed.

The second coupling line 15 for decoupling the forward power is disposed at a larger vertical separation from the transmission line 11. The second coupling line 15 is also disposed on an electrical insulator 16 that is designed as a printed circuit board. Due to the larger separation between the second coupling line 15 and the transmission line 11, power is decoupled at a smaller coupling factor by way of the second coupling line 15. The separation between the second coupling line 15 and the transmission line 11 can be predetermined. The coupling line 15 is offset from the transmission line 11 by the vertical separation, and the coupling line 15 does not overlap the first coupling line 13. This ensures electrical decoupling of the two coupling lines 13, 15.

Each coupling line 13, 15 has a predetermined and adjusted characteristic impedance, and the impedance can be adjusted with precision by selecting or by determining the separations between, the coupling line 13, 15 and the ground surface 10. Because the reference potential of the ground surface 10 is fixed, a fixed characteristic impedance can be predetermined with, precision, reliability, and high repetition accuracy. In some implementations, the characteristic impedance of each coupling line 13, 15 can be set as that commonly used in industry. For example, the characteristic impedance can be 50 ohms or 75 ohms. In some implementations, the characteristic impedance can be adjusted by adjusting the length and/or width of the coupling lines 13, 15.

A second reference member that is at ground potential (in this implementation, the second reference member is a second ground surface 17) is provided in a further plane adjacent the insulator 16. The ground surfaces 10, 17 can be connected to several through-contacts (not shown) formed in the printed circuit boards of the insulators 12, 14, 16 to electrically connect the ground surfaces 10, 17 in order to ensure that the current in the ground surfaces 10, 17 is homogeneous. The coupling lines 13, 15 are disposed at a defined vertical separation from the ground surface 17, thereby precisely determining the characteristic impedance of the coupling lines 13, 15. Additionally, there is no coupling line (either 13 or 15) between the transmission line (11) and a ground potential such as the ground surface 10. The characteristic impedance is determined by the length and the width of the coupling lines 13, 15. The length and width of the coupling lines 13, 15 and the vertical separation of the coupling lines 13, 15 from the ground surface 17 are thereby matched in order to obtain a defined, predetermined characteristic impedance for each coupling line 13, 15.

The separation between the coupling lines 13, 15 and one or more of the ground surfaces 10, 17 can be predetermined. Moreover, the characteristic impedance of each coupling line 13, 15 can be adjusted with some precision based on one ground reference potential and the electrical coupling between the transmission line 11 and the coupling lines 13, 15 can be adjusted using the second ground reference member.

The coupling lines 13, 15 can be embedded between the respective electrical insulators 12, 14 and 14, 16. The transmission line 11 can be insulated from the ground surface 10.

Coupling between the coupling lines 13, 15 and the transmission line 11 can be effected through electrical and magnetic fields. If done in this manner, the electric and magnetic couplings need to be balanced. Magnetic coupling can be done through the progression of the lines of magnetic flux in the area of the section where the coupling lines 13, 15 are guided in the direct vicinity of the transmission line 11. Electric coupling can be produced through the progression of the lines of electric flux between the transmission line 11 and the respective coupling line 13 or 15, and the area of the respective coupling line. Short coupling lines 13, 15 imply little magnetic coupling, and to provide balance, little electric coupling would be required in this case.

The progression of the lines of flux can be deflected by the ground surface 10, which, in the implementation shown in FIG. 2, is on the same plane as the transmission line 11. In this way, the lines of flux can be directed away from the coupling lines by the ground surface 10 to reduce electric coupling between the transmission line 11 and the coupling lines 13, 15. Moreover, the lines of flux of the electric field between the transmission line 11 and the coupling lines 13, 15 can be diverted by the ground surface 10 even if there is no coupling line between the transmission line 11 and the ground potential at the ground surface 10 in order to reduce the electric coupling between the transmission line and the coupling lines 13, 15.

In some implementations, the forward power and the reflected power (or values describing them) can be decoupled from the transmission line 11 with different coupling factors (that is, that portion of power that is coupled out of the transmission line 11 by ground surface 10). Usually, the reflected power is smaller than the forward power. If the reflected power is decoupled with a larger coupling factor than the forward power, the signal-to-noise ratio at the input of the evaluation device 7 increases because the temporal behavior of the evaluation device 7 in reaction to an input signal is advantageously utilized. In this way, the reflected power can be measured more precisely. Different coupling factors can be realized by positioning the coupling lines 13, 15 at different separations from the transmission line 11. The coupling factors are also influenced by the length and width of the coupling lines 13, 15, and the width and the length of the transmission line 11. The coupling factors can be adjusted by disposing the transmission line 11, the coupling line 13, and the coupling line 15 in different planes. Moreover, the coupling lines 13, 15 can be offset from each other to reduce or prevent coupling between the coupling lines and therefore to reduce or prevent errors in the measurement results.

In another implementation, the first ground surface 10 can be disposed in a plane that is distinct from the plane in which the transmission line 11 is disposed. For example, the first ground surface 10 can be disposed in a plane that is above and is parallel with a plane of the transmission line 11. The ground surface 10 influences the electric field in the surroundings of the transmission line 11. With this measure, the electric coupling between the transmission line 11 and the coupling lines 13, 15 can be influenced and adjusted.

Figure 3A:
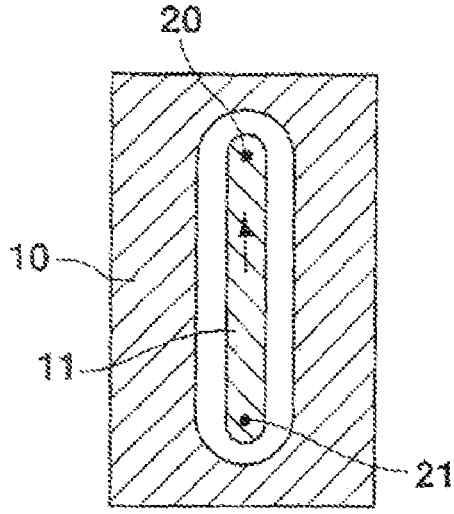
FIGS. 3*a*-3*c* show top views of the different planes of the directional coupler of FIG. 2.

FIG. 3*a* shows a top view of the ground surface 10 and the transmission line 11. The transmission line 11 is completely embedded in the ground surface 10 and is thereby also shielded by it. The directional coupler 3 can include an input terminal 21 for connecting to the HF generator 2 and an output terminal 20 for connecting to the plasma load 4.

Figure 3B:
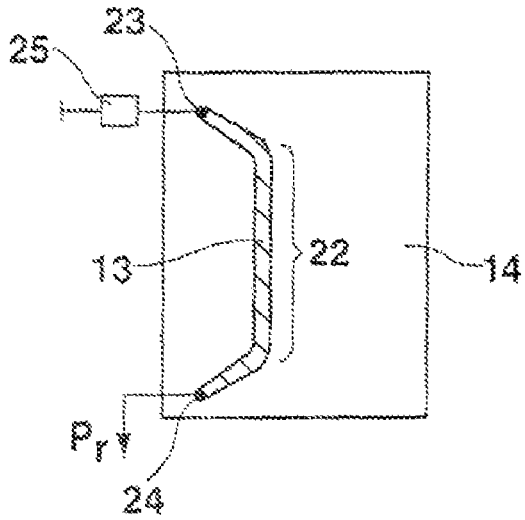

FIG. 3*b* shows a top view of the electrical insulator 14 on which the first coupling line 13 is disposed. The coupling line 13 is bent outside of a coupling area 22, and in the coupling area 22, the first coupling line 13 extends parallel to the transmission line 11 such that connections 23, 24 of the first coupling line 13 are remote from the transmission line 11. A resistance 35 is exclusively connected to the connection 23, and the resistance 25 has resistance value that corresponds within a suitable tolerance to the characteristic impedance of the first coupling line 13. The connection 23 electrically couples to the transmission line 11. The connection 24 can be connected to the measuring device 6 to supply a quantity that describes the reflected power $P_r$.

Figure 3C:
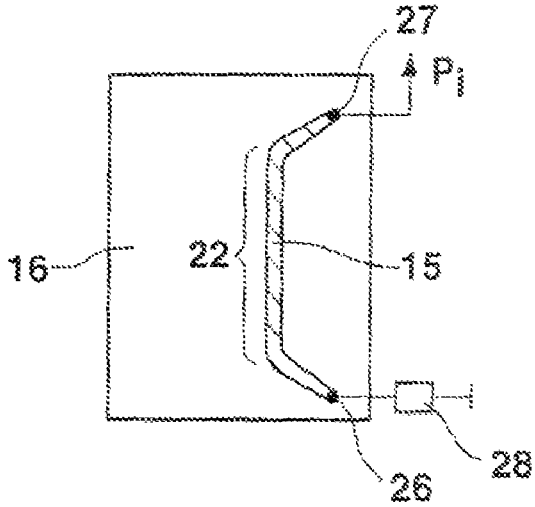

FIG. 3*c* shows a top view of the insulator 16 on which the second coupling line 15 is disposed. The coupling line 15 is bent outside of the coupling area 22, and in the coupling area 22, the second coupling line 15 extends parallel to the transmission line 11 such that connections 26, 27 of the second coupling line 15 are remote from the transmission line 11 and from the connections 23, 24 of the first coupling line 13. A resistance 28 is exclusively connected to the connection 26, and the resistance 28 has a resistance value that corresponds within a suitable tolerance to the characteristic impedance of the second coupling line 15. The connection 26 electrically couples to the transmission line 11. The connection 27 can be connected to the measuring device 5 to supply a quantity that describes the forward power $P_r$.

In some implementations, the length of the coupling lines 13, 15 in the coupling areas 22 can be less than $\lambda/4$. In other implementations, the length of the coupling lines 13, 15 in the coupling areas 22 can be less than $\lambda/8$. In other implementations, the length of the coupling lines 13, 15 in the coupling areas 22 can be less than $\lambda/10$. In this way, the dimensions of the directional coupler 3 can be kept relatively small. If the coupling lines 13, 15 are relatively short, for example, shorter than $\lambda/4$, then coupling between the coupling lines 13, 15 and the transmission line 11 in accordance with line theory can be neglected.

For example, the resistance values of the resistances 25, 28 can match or equal the characteristic impedance of the directional coupler 3. That is, the resistance values of the resistances 25, 28 can correspond (within a tolerance of less than ±10%) to the characteristic impedance of the respective coupling line 13, 15. As another example, the resistance values of the resistances 25, 28 can correspond within a tolerance of less than ±5% to the characteristic impedance of the respective coupling line 13, 15. As a further example, the resistance values of the resistances 25, 28 can correspond within a tolerance of less than ±1% to the characteristic impedance of the respective coupling line 13, 15. Moreover, reflections produced by the measurement can be absorbed at the resistances 25, 28 and therefore no new reflections are produced that can potentially contribute to measurement errors at the other coupling line. Reflections due to mismatch can be reduced or prevented through adjustment of the resistances 25, 28 relative to the characteristic impedances of the coupling lines 13, 15 and the tolerances in the directional coupler 3 can be compensated for by such adjustment.

If the directional coupler 3 is designed for operation at frequencies of less than 200 MHz or at frequencies of less than 40 MHz, it can be well suited for operation in HF plasma process excitation configurations such as the configuration 1.

Figure 4:
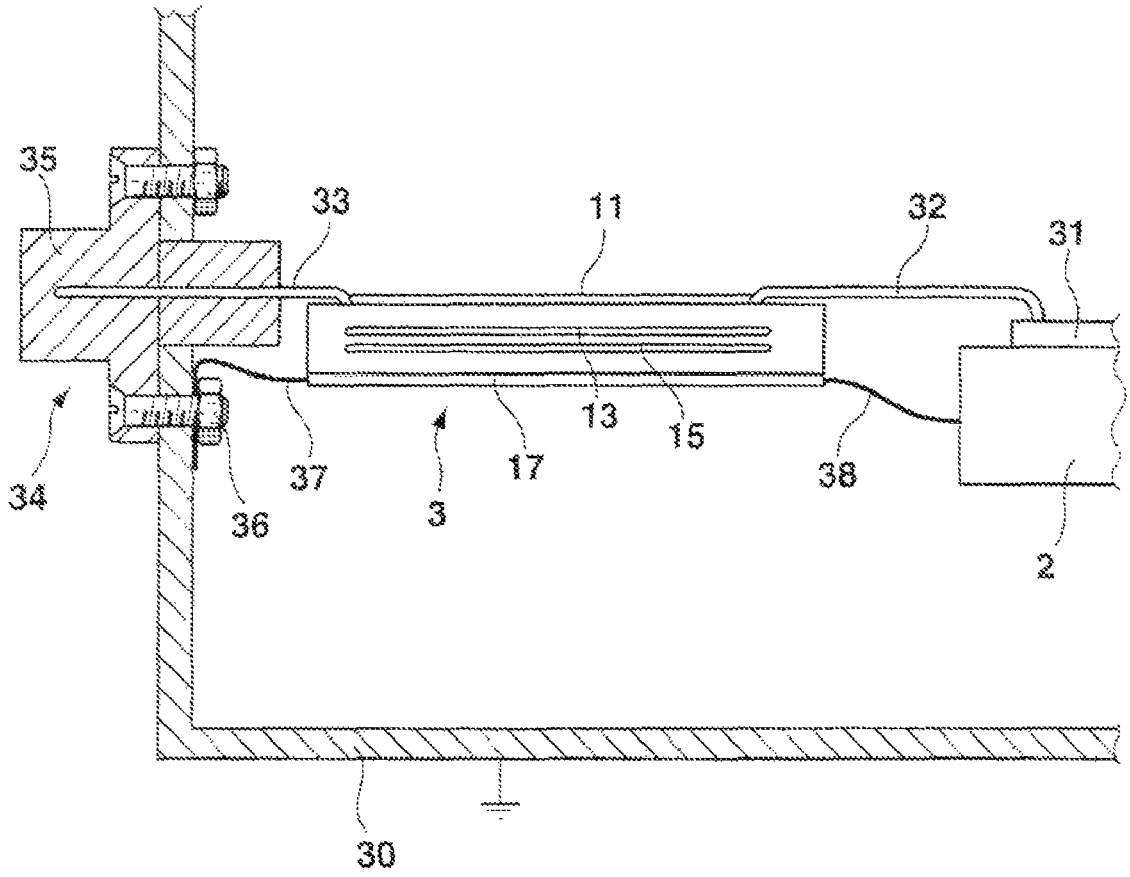
FIG. 4 shows a schematic view of the configuration of a directional coupler in a housing of an HF plasma process excitation configuration.

In FIG. 4, the HF generator 2 and the directional coupler 3 are disposed in a housing 30, and the housing 30 is connected to a ground reference member that is at a ground potential. An output terminal 31 of the HF generator 2 is connected to the transmission line 11 of the directional coupler 3 by way of a line 32. The transmission line 11 of the directional coupler 3 is, in turn, connected to an inner conductor 33 of an output terminal 34 that is designed as a connector, for example, a coaxial connector. An outer conductor 35 of the output terminal 34 is connected on a large surface to the housing 30 using mounting devices 36 such as nuts and screws. In particular, the current returned from the plasma load 4 on the outer conductor 35 reaches the housing 30 at and through the outer conductor 35. In order to ensure that a substantial part of the return current flows through the second ground surface 17 and not through the housing 30, a short connecting line 37 is provided between the second ground surface 17 and the output terminal 34 for example, by connection to the mounting devices 36, which provide a direct, short, and large-surface connection to the ground surface 17. The second ground surface 17 is connected to the HF generator 2, for example, its ground potential, through a short line 38.

The connecting fines 37, 38 can be produced from any electrically conductive material such as copper or silver, which have a high electric conductivity. The length of the connecting lines 37, 38 can be ≦10 mm and the width can be ≧5 mm, in particular ≧10 mm. The flat short design of the connecting lines 37, 38 realizes a low-inductance connection between the outer conductor 35 and the ground of the HF generator 2 through the ground surface 17.

The housing 30 can be modified in order to increase the resistance for the returned HF current to thereby ensure that the return current flows substantially through the ground surface 17. For example, the housing 30 can be modified such that connecting elements (that is, elements that connect the HF generator 2 to the housing 30, for example, the lines 37, 38) between the housing 30 and the ground of the HF generator 2 can be ferrite rings. As another example, the connecting elements can be made of materials with a high relative permeability $\mu_r$, since a high $\mu_r$ increases the skin effect, thereby impairing the HF current conduction. With this measure, the electric and magnetic fields are formed, which are required for good coupling between the coupling lines 13, 15 and the transmission line 11.

In this way, the entire return current from the plasma load 4 to the HF generator 2 flows through the ground surface 17. The DC resistance of the housing 30 can be increased by introducing inductances into the current path. Alternatively or additionally, the current path can be built up with little inductance through the ground potential of the directional coupler 3 to the ground of the HF generator 2.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A directional coupler for an HF plasma process excitation configuration, the directional coupler comprising:

a transmission line;

a first coupling line configured for detecting reflected power by electrical coupling with the transmission line, the first coupling line being spaced apart from the transmission line and being terminated at least at one end with a termination resistance; and a second coupling line configured for detecting forward power by electrical coupling with the transmission line, the second coupling line being spaced apart from the transmission line and being terminated at least at one end with a termination resistance;

wherein each coupling line has a predetermined and adjusted characteristic impedance, and the termination resistance of each of the coupling lines has a resistance value that corresponds within a tolerance to the characteristic impedance of the associated coupling line and further comprising a first ground reference member at ground potential and being defined by a ground surface, the transmission line is disposed in the same plane as the ground surface and the transmission line is electrically insulated from the ground surface, and wherein the forward power and the reflected power, or quantities describing the forward power and the reflected power, are decoupled from the transmission line with different coupling factors.

2. The directional coupler of claim 1, wherein the tolerance is less than ±10%.

3. The directional coupler of claim 1, wherein the tolerance is less than ±5%.

4. The directional coupler of claim 1, wherein the tolerance is less than ±1%.

5. The directional coupler of claim 1, wherein the directional coupler is designed for operation at frequencies of less than about 200 MHz.

6. The directional coupler of claim 1, further comprising a second ground reference member at ground potential, wherein the coupling lines are disposed between the first and second ground reference members, and the distance of the coupling lines from at least one of the first and second ground reference members is predeterminable.

7. The directional coupler of claim 1, further comprising a second ground reference member at ground potential, wherein the coupling lines are disposed between the ground reference members, and the distance of the coupling lines from the first and second ground members is predeterminable.

8. The directional coupler of claim 1, further comprising a second ground reference members at ground potential, wherein the first and second ground reference members are defined by two ground surfaces and the coupling lines are disposed between the two ground surfaces.

9. The directional coupler of claim 1, wherein the directional coupler is designed for operation at frequencies of less than about 40 MHz.

10. The directional coupler of claim 1, wherein there is no coupling line between the transmission line and the first ground reference member at ground potential.

11. The directional coupler of claim 1, wherein each of the coupling lines has exclusively a termination resistance at one end.

12. The directional coupler of claim 1, wherein parallel sections of the coupling lines and the transmission line have a length of less than $\lambda/4$, where $\lambda$ is the wavelength of the power signal from an HF generator to a plasma load through the transmission line.

13. The directional coupler of claim 1, wherein the transmission line includes an input terminal and an output terminal.

14. The directional coupler of claim 1, wherein the first and the second coupling lines are disposed at different distances from the transmission line.

15. The directional coupler of claim 1, wherein the transmission line receives at its input terminal forward power from an HF generator and delivers at its output terminal the forward power to a plasma load.

16. The directional coupler of claim 1, wherein the coupling lines are offset from each other.

17. The directional coupler of claim 1, wherein the first coupling line, the second coupling line, and the transmission line are separated from each other by an electrically insulating material.

18. The directional coupler of claim 17, wherein the electrically insulating material includes a printed circuit board material.

19. A high frequency (HF) plasma process excitation configuration comprising:

a HF generator;

a plasma load; and a directional coupler, wherein the directional coupler comprises a transmission line including an input terminal connected to the HF generator and an output terminal connected to the plasma load;

a first coupling line configured for detecting reflected power reflected from the plasma load by electrical coupling with the transmission line, the first coupling line being spaced apart from the transmission line and being terminated at least at one end with a termination resistance; and a second coupling line configured for detecting forward power provided by the HF generator by electrical coupling with the transmission line, the second coupling line being spaced apart from the transmission line and being terminated at least at one end with a termination resistance;

wherein each coupling line has a predetermined and adjusted characteristic impedance, and the termination resistances of the coupling lines each have a resistance value that corresponds within a tolerance to the characteristic impedance of the associated coupling line, and further comprising a first ground reference member at ground potential and being defined by a ground surface, the transmission line is disposed in the same plane as the ground surface and the transmission line is electrically insulated from the ground surface, and wherein the forward power and the reflected power, or quantities describing the forward power and the reflected power, are decoupled from the transmission line with different coupling factors.

20. A high frequency (HF) plasma process excitation configuration comprising a directional coupler, wherein the directional coupler comprises:

a transmission line including an input terminal and an output terminal;

a first coupling line for detecting reflected power by electrical coupling with the transmission line, the first coupling line being spaced apart from the transmission line and being terminated at least at one end with a termination resistance; and a second coupling line for detecting forward power by electrical coupling with the transmission line, the second coupling line being spaced apart from the transmission line and being terminated at least at one end with a termination resistance;

wherein each coupling line has a predetermined and adjusted characteristic impedance, and the termination resistances of the coupling lines each have a resistance value that corresponds within a tolerance to the characteristic impedance of the associated coupling line and wherein most of the return current flows from a plasma load to an HF generator through a ground surface of the directional coupler.

21. The HF plasma excitation configuration of claim 20, wherein more than about 90% of the return current flows from the plasma load to the HF generator through the ground surface of the directional coupler.

22. A high frequency (HF) plasma process excitation configuration comprising a directional coupler, wherein the directional coupler comprises:

a transmission line including an input terminal and an output terminal;

a first coupling line for detecting reflected power by electrical coupling with the transmission line, the first coupling line being spaced apart from the transmission line and being terminated at least at one end with a termination resistance; and a second coupling line for detecting forward power by electrical coupling with the transmission line, the second coupling line being spaced apart from the transmission line and being terminated at least at one end with a termination resistance;

wherein each coupling line has a predetermined and adjusted characteristic impedance, and the termination resistances of the coupling lines each have a resistance value that corresponds within a tolerance to the characteristic impedance of the associated coupling line and wherein the HF resistance for the return current between an output teiminal of the HF plasma excitation configuration and the ground surface of the directional coupler is smaller than the HF resistance of a housing between the output terminal and the ground potential of the housing.

23. A directional coupler for an HF plasma process excitation configuration, the directional coupler comprising:

a transmission line;

a first coupling line configured for detecting reflected power by electrical coupling with the transmission line, the first coupling line being spaced apart from the transmission line and being terminated at least at one end with a termination resistance; and a second coupling line configured for detecting forward power by electrical coupling with the transmission line, the second coupling line being spaced apart from the transmission line and being terminated at least at one end with a termination resistance;

wherein each coupling line has a predetermined and adjusted characteristic impedance, and the termination resistance of each of the coupling lines has a resistance value that corresponds within a tolerance to the characteristic impedance of the associated coupling line, the directional coupler further comprising a first ground reference member at a ground potential, the first and second coupling lines are disposed at a predetermined distance from the first ground reference member, and there is no coupling line between the transmission line and the first ground reference member at ground potential.

* * * * *

UNITED STATES PATENT AND TRADEMARK OFFICE

CERTIFICATE OF CORRECTION

PATENT NO. : 7,755,451 B2
APPLICATION NO. : 11/689043
DATED : July 13, 2010
INVENTOR(S) : Daniel Krausse et al.

It is certified that error appears in the above-identified patent and that said Letters Patent is hereby corrected as shown below:

Column 11, claim 8, line 25, delete “members” and insert --member--.

Column 13, claim 22, line 12, delete “teiminal” and insert --terminal--.

Signed and Sealed this
Twenty-eighth Day of June, 2011

David J. Kappos

David J. Kappos
*Director of the United States Patent and Trademark Office*